United States Patent [19]

Falce

[11] 4,233,539

[45] Nov. 11, 1980

[54] ELECTRON TUBE WITH REDUCED SECONDARY EMISSION

[75] Inventor: Louis R. Falce, Redwood City, Calif.

[73] Assignee: Varian Associates, Inc., Palo Alto, Calif.

[21] Appl. No.: 17,316

[22] Filed: Mar. 5, 1979

[51] Int. Cl.[3] ..... H01J 23/08

[52] U.S. Cl. ..... 315/5.38; 313/106; 313/107; 427/77

[58] Field of Search ..... 315/5.38; 313/106, 107, 313/353; 427/77

[56] References Cited

U.S. PATENT DOCUMENTS

| | | | |
|---|---|---|---|
| 2,171,230 | 8/1939 | Wamsley | 313/107 |
| 2,516,841 | 8/1950 | Arditi et al. | 313/107 |
| 2,821,496 | 1/1958 | Perl | 313/107 X |
| 2,990,495 | 6/1961 | Spencer | 313/106 X |
| 3,389,285 | 6/1968 | Thomson | 313/107 |
| 3,936,695 | 2/1976 | Schmidt | 315/5.38 |

*Primary Examiner*—Saxfield Chatmon, Jr.

*Attorney, Agent, or Firm*—Stanley Z. Cole; Richard B. Nelson; Keiichi Nishimura

[57] ABSTRACT

Secondary electrons emitted from an electron-collecting electrode of a vacuum tube degrade the performance. Emission of high-speed secondaries is reduced by coating the electron-collecting surface with a material of low atomic number. Emission of low-speed secondaries is a less predictable function of the surface material and structure. The invention comprises a coating of aluminum boride or similar substance, which has low secondary emission and is also easy to outgas.

6 Claims, 4 Drawing Figures

ELECTRON TUBE WITH REDUCED SECONDARY EMISSION

FIELD OF THE INVENTION

The invention pertains to vacuum tubes utilizing a stream of free electrons, such as triodes, screen-grid tubes, klystrons, traveling-wave tubes and magnetrons.

PRIOR ART

The deleterious effects of secondary electrons in many vacuum tubes are well-known. In high-power grid-controlled tubes the grids have been coated with carbon, titanium or metal carbides such as zirconium carbide. These materials reduce the total secondary emission.

In linear-beam tubes two effects due to secondaries have been recognized. When the beam collector is "depressed", i.e., operated at a potential negative with respect to the interaction circuit, secondaries of any speed from the collector may be driven to the electrodes of more positive potential, thereby decreasing the efficiency. Also, particularly in klystons, high-speed secondaries (or "reflected electrons") can return backward down the beam path and interact with the cavity field to produce regeneration and consequent non-linear response. U.S. Pat. Nos. 3,806,755 issued Apr. 23, 1974 to E. L. Lien and M. E. Levin and No. 3,936,695 issued Feb. 3, 1976 to Robert C. Schmidt describe geometric arrangements to reduce the number or effect of returning secondaries. Another prior-art scheme that has been used is to coat the collecting surface with colloidal graphite, such as sold under the trademark "Aquadag". Carbon has low yields of both high and low-speed secondaries, but the graphite coating was found to outgas for a long time, doubling the time required to evacuate the tube.

SUMMARY OF THE INVENTION

An object of the invention is to provide an electron tube with reduced secondary emission from the electrodes.

A further object is to provide a tube with improved linearity of response.

A further object is to provide a linear-beam tube with higher efficiency.

A further object is to provide a tube which is easy to evacuate.

These objects are achieved by coating electrodes which may be struck by electrons with a layer of material having a low yield of both high-speed and low-speed secondary electrons, and which is easy to outgas. Aluminum boride is the preferred material.

DESCRIPTION OF THE PREFERRED EMBODIMENT

All materials when bombarded by electrons of more than a few volts energy emit secondary electrons. These are of two general classes. Most are low speed, sometimes called "true secondaries," having velocities corresponding to energies of a few electron volts. The yield of these slow secondaries, that is the ratio of their number to the number of bombarding electrons, varies widely from less than one to the order of 100. It depends on the materials, the thickness of surface layers down to monatomic layers, and the physical form of the materials near the surface. Often surfaces with low work functions have high yields, but there is no simple relationship. Thin layers of stable oxide such as beryllia or alumina on metal substrates often have very high yields.

There are also some high-speed secondary electrons emitted with almost the energy of the incident primaries. These are sometimes called "reflected" electrons. The yield of high-speed secondaries is predictable. It is an increasing function of the atomic numbers of the emitting materials. It is, of course, always less than one.

In most vacuum tubes using free electrons, secondaries are harmful. In tubes with control grids swinging to potentials positive with respect to the cathode, secondary emission from the grid can cause negative resistance loading on the grid circuit with consequent non-linear response. This kind of emission has been partially controlled by coating grids with prior-art materials such as carbon or metal carbides, which also reduce harmful thermionic emission. The coating process is carried out at high temperature which precludes its use on electrodes made of copper, such as the anodes or beam collectors of high power tubes.

Another secondary emission fault in grid-controlled tubes occurs in tetrodes where the anode swings negative with respect to the screen grid. Then secondary emission from the anode reduces the rf current in the anode circuit and causes a positive resistance loading. The fault has in the past been reduced by introducing a suppressor grid between screen and anode or by focusing the electron streams to produce a potential depression by space charge. If the secondary emission is eliminated, these tubes can be made much simpler.

Figure 1:
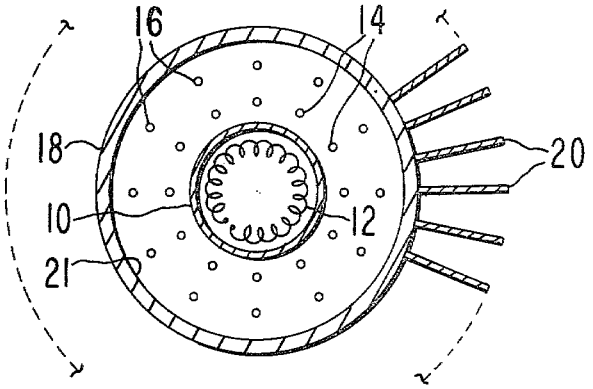
FIG. 1 is a schematic cross-section of a gridded tetrode embodying the invention.

FIG. 1 illustrates a tetrode embodying the invention. The tube is generally cylindrical. A cylindrical cathode 10 heated by an interior radiant heater 12 is the electron source. Outside cathode 10 is a cylindrical array of control-grid wires 14 in the conventional "squirrel cage" arrangement. Outside grid 14 is a similar screen grid 16, whose wires are preferably aligned radially with wires 14. Surrounding all this is a cylindrical anode 18, preferably of copper, attached to air-cooling fins 20. The inside surface of anode 18 which collects the electrons is coated with a layer 21 of my inventive material having low secondary emission. Aluminum boride is a preferred coating because it can be applied easily, as by sputtering. I have found that it adheres well to a copper surface and does not exude gas for a long time as did prior-art materials such as colloidal graphite. In fact, linear-beam tubes using my invention have been processed in one-half the time required when graphite was used.

The tetrode of FIG. 1 is of simpler construction and cheaper than a pentode and can be more efficient than a pentode or beam power tube, particularly at high frequencies, because there are fewer restrictions on electrode spacings.

Figure 2:
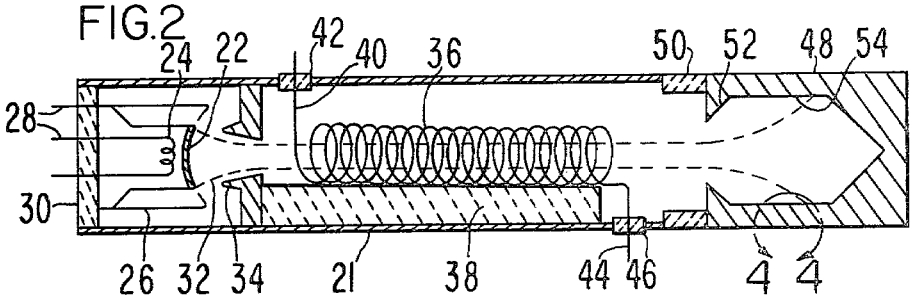
FIG. 2 is a schematic cross-section of a traveling-wave tube embodying the invention.

FIG. 2 illustrates a traveling-wave tube embodying the invention. A hermetic envelope 21 forms the vacuum wall. A concave thermionic cathode 22 heated by a radiant heater 24 is the source of electrons. Cathode 22 is surrounded by a beam-focussing electrode 26 at the same potential. Current is supplied to cathode 22 and heater 24 by leads 28 sealed through an insulating disc 30, as of alumina ceramic. A converging stream of electrons 32 is drawn from cathode 22 by a reentrant anode 34 having an opening to allow stream 32 to pass through and on inside the slow-wave interaction circuit 36 formed of a helical wire or tape, as of tungsten. Within helix 36 the electron beam 32 is kept focussed into a small cylindrical shape by an axial magnetic field produced by a surrounding solenoid (not shown). Helix 36 is supported by a plurality of dielectric rods 38, as of sapphire, inside envelope 21. At its upstream end it is connected by input lead 40 passing through a dielectric seal 42 to an external signal source (not shown). At its downstream end helix 36 is connected by an output lead 44 through a dielectric seal 46 to a useful load for the amplified high-frequency signal (not shown). After leaving helix 36, beam 32 leaves the magnetic focussing field, expands and is collected on the hollow interior of collector 48, typically made of copper for good conduction of the generated heat. Collector 48 is mounted on envelope 21 via a dielectric seal 50 so that it may be operated at a potential different from that of envelope 21 and helix 36. At the entrance to collector 48 the opening is constricted by an inward-extending lip 52 forming a "fly trap" which serves to reduce the number of secondary electrons leaving collector 48.

Traveling-wave tubes are very often operated with the collector at a potential less positive (with respect to the cathode) than the potential of the interaction circuit and tube envelope. This reduces the kinetic energy of the "spent" beam electrons; hence the power flow to the collector. Considerable improvement in efficiency of the tube is obtained. A problem has always been that secondary electrons from the collector are drawn back by the potential difference to strike the interaction circuit or tube envelope. They create undesirable heat dissipation on those parts not designed for high dissipation. Also, this current from collector to circuit respresents wasted energy, so the efficiency improvement from depressing the collector is reduced. To improve the efficiency under depressed-collector operation, the inside of collector 48 is coated with a layer 54 of my inventive material with low total secondary emission.

Aluminum boride as described in connection with FIG. 1, is the preferred material, although other materials may be used within the scope of the invention. For example, I have found aluminum carbide to be an effective secondary emission suppressor. It has the disadvantage of reacting with water vapor so it is very difficult to apply. I have also found boron carbide to be quite effective, but it is not as easily deposited by sputtering as aluminum boride. Metallic aluminum and beryllium have low secondary yields when the surface is clean, but react with air or water to form an oxide film which has very high secondary yield.

Figure 3:
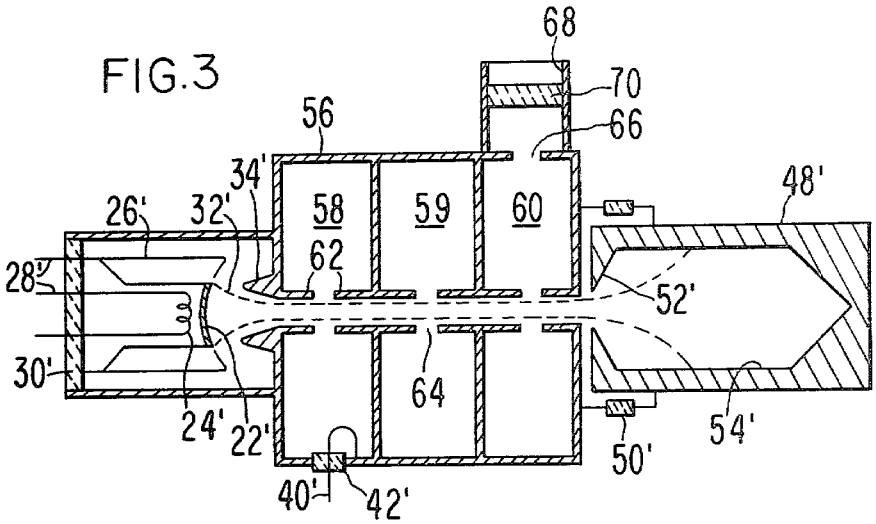
FIG. 3 is a schematic cross-section of a klystron embodying the invention.

FIG. 3 illustrates a klystron embodying the invention. The beam forming and collecting elements have the same form and function as in the traveling-wave tube of FIG. 2, so are designated by primes and will not be discussed again. The klystron vacuum envelope 56, of metal, is subdived into a plurality of resonant cavities 58, 59, 60, each cavity having two reentrant hollow drift-tubes 62 defining an interaction gap 64. Electron beam 32′ passes through drift tubes 62 and interacts with the microwave electric fields across gaps 64.

The first cavity 58 has an input coupling loop 65 for exciting cavity 58 with a microwave signal introduced via a conductor 40′ entering through a dielectric vacuum seal 42′.

The amplified microwave signal is coupled out of the final cavity 60 by an iris 66 leading into an output waveguide 68 which is sealed off by a dielectric window 70. Beam 32′ is focussed to a pencil shape through drift tubes 62 by an axial magnetic field (not shown). On leaving drift tubes 62, beam 32′ expands and is caught on the inner surface 54′ of a collector 48′.

A problem peculiar to klystrons is caused by high-speed secondary electrons emitted from the inner surface 54′ of collector 48′. Some of these electrons return through drift tubes 62 back toward cathode 22′. This returning beam interacts with gaps 64, being velocity modulated by output cavity 60. It can then induce an amplified signal in input cavity 58. The end result is regenerative amplification which can cause non-linear response to the input signal. Although the returned beam may have very little current, klystrons often have gains of some 50 dB so that even a small current can cause a greatly amplified regenerative signal. The effect is particularly troublesome in klystrons used to amplify amplitude-modulated signals such as in television transmitters.

According to my invention, inside surface 54′ of collector 48′ is coated with my low-secondary-yield material. The coating produces a great improvement in klystron linearity by reducing the number of high-speed secondary electrons emitted, without increasing the outgassing of the collector. The invention can be used in combination with the geometric schemes described in the above-mentioned U.S. patents to produce still further improvement.

Figure 4:
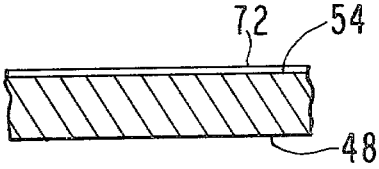
FIG. 4 is an enlarged view of a portion of the collector 48 of FIG. 2 showing the inventive coating.

FIG. 4 is an enlarged view of a section of the wall of collector 48, showing the thin layer 72 of low-emission material on the inner surface 54 of collector 48. Layer 72 may be quite thin, such as a sputtered-on thickness of a few microns. Aluminum boride is quite stable chemically and appears to stay effective for an indefinite life.

The above preferred embodiments are intended to be illustrative examples only. It will be obvious to those skilled in the art that many other variations of my invention may be practical and useful. The scope of the invention is to be limited only by the following claims and their legal equivalents.

I claim:

1. An electron tube comprising a copper electrode capable of collecting free electrons, at least a portion of the collecting surface of said electrode being coated with a layer of material of the class consisting of aluminum boride, aluminum carbide and boron carbide.

2. The tube of claim 1 wherein said material is aluminum boride.

3. The tube of claim 1 wherein said material is aluminum carbide.

4. The tube of claim 1 wherein said material is boron carbide.

5. The tube of claim 1 wherein said tube is a linear-beam tube and said electrode is the beam collector.

6. The tube of claim 1 wherein said tube is a grid-controlled tube comprising a screen grid and said electrode is the anode.

* * * * *